US007503883B2

(12) United States Patent
Madden

(10) Patent No.: US 7,503,883 B2
(45) Date of Patent: Mar. 17, 2009

(54) RESISTANCE EXERCISE DEVICE

(75) Inventor: Michael J. Madden, Mission, TX (US)

(73) Assignee: Spri Products, Inc., Libertyville, IL (US)

( * ) Notice: Subject to any disclaimer, the term of this patent is extended or adjusted under 35 U.S.C. 154(b) by 0 days.

(21) Appl. No.: 11/757,866

(22) Filed: Jun. 4, 2007

(65) Prior Publication Data

US 2008/0300117 A1 Dec. 4, 2008

(51) Int. Cl.
*A63B 21/02* (2006.01)

(52) U.S. Cl. ..... 482/126; 482/121

(58) Field of Classification Search ..... 482/39–40, 482/121–126, 81–82, 74
See application file for complete search history.

(56) References Cited

U.S. PATENT DOCUMENTS

| | | | |
|---|---|---|---|
| 232,579 | A | 9/1880 | Weeks |
| 1,112,114 | A | 9/1914 | Caines |
| 1,965,511 | A | 7/1934 | Preston |
| 2,680,967 | A | 6/1954 | Newman |
| 3,103,357 | A | 9/1963 | Berne |
| 3,288,413 | A | 11/1966 | Gregory |
| 3,415,515 | A | 12/1968 | Otto |
| 3,430,953 | A | 3/1969 | Teetor |
| 3,587,319 | A | 6/1971 | Andrews |
| 3,643,947 | A | 2/1972 | Collins |
| 3,659,844 | A | 5/1972 | Cummins |
| 3,847,422 | A | 11/1974 | Gulistan |
| 3,923,302 | A | 12/1975 | Boggild |
| 3,956,911 | A | 5/1976 | Carboud |
| 3,984,136 | A | 10/1976 | Bills |
| 4,018,437 | A | 4/1977 | LoPresti |
| 4,109,907 | A | 8/1978 | Zito |
| 4,113,221 | A | 9/1978 | Wehner |

(Continued)

FOREIGN PATENT DOCUMENTS

DE 2004-006483 U1 8/2004

(Continued)

OTHER PUBLICATIONS

Sporttime—"The Big Red Base System"; Catalog; 44-49 and 203 (Spring 2001).

(Continued)

*Primary Examiner*—Fenn C Mathew
(74) *Attorney, Agent, or Firm*—Barnes & Thornburg LLP

(57) ABSTRACT

A resistance exercise device comprising at least one handle and a cord having a pair of ends and a length extending between the pair of ends, the handle being secured to one of the ends of the cord, the cord being stretchable to extend the length and comprising a plurality of tubes extending substantially the entire length of the cord, the tubes being conjoined together along substantially the entire length of the cord by means of braiding. The tubes are conjoined together such that the tubes are snug along substantially the entire length of the cord and such that each of the tubes is in contact with at least one of the other tubes substantially along the entire length of the cord. The resistance exercise device may further comprise a plug and sleeve for securing the handle to the end of the cord.

9 Claims, 3 Drawing Sheets

U.S. PATENT DOCUMENTS 4,182,510 A 1/1980 Lundell
4,185,816 A 1/1980 Bernstein
4,212,458 A 7/1980 Bizilia
4,266,766 A 5/1981 Calderone
4,330,131 A 5/1982 Warehime
4,357,010 A 11/1982 Telle
4,412,677 A 11/1983 Viramontes
4,419,990 A 12/1983 Forster
D277,218 S 1/1985 Hinds
4,572,505 A 2/1986 Kornhaus
4,662,629 A 5/1987 Plovie
4,720,099 A 1/1988 Carlson
4,733,862 A * 3/1988 Miller ..... 482/126
4,749,185 A 6/1988 Spears
4,779,867 A 10/1988 Hinds
4,787,626 A 11/1988 Gallagher
4,809,971 A 3/1989 Goldish
4,848,741 A 7/1989 Hermanson
4,944,518 A 7/1990 Flynn
5,135,445 A 8/1992 Christensen
5,152,728 A 10/1992 Podd
5,176,602 A 1/1993 Roberts
5,183,452 A 2/1993 Bacon
5,230,676 A 7/1993 Terauds
5,342,274 A 8/1994 Hunker
5,354,253 A 10/1994 Awbrey
5,372,556 A 12/1994 Ropp
5,393,286 A 2/1995 Cheng
5,407,414 A 4/1995 Bass
5,431,617 A 7/1995 Rattray
5,468,205 A 11/1995 McFall et al.
5,505,677 A 4/1996 Hinds
5,514,059 A 5/1996 Rumney
5,540,643 A 7/1996 Fontaine
5,549,528 A 8/1996 Bryant
5,549,532 A 8/1996 Kropp
5,554,088 A 9/1996 Zlojutro
5,571,064 A 11/1996 Holm
5,603,681 A 2/1997 Olschansky
5,626,546 A 5/1997 Little
5,676,627 A 10/1997 Howse
5,690,595 A 11/1997 Quinones
5,716,308 A 2/1998 Lee
5,720,701 A 2/1998 Truini
5,720,702 A 2/1998 Lee
5,769,734 A 6/1998 Qualey, Sr.
5,792,032 A 8/1998 Williams
5,800,322 A 9/1998 Block
5,800,323 A 9/1998 Ansel
5,885,190 A 3/1999 Reiter
5,895,343 A 4/1999 Huang
6,001,048 A * 12/1999 Taylor ..... 482/81
6,036,625 A 3/2000 Woodruff
6,063,010 A 5/2000 Howd et al.
6,080,089 A 6/2000 Nicholson
6,120,421 A 9/2000 Koo
6,202,263 B1 3/2001 Harker
6,206,811 B1 3/2001 Lat
6,254,517 B1 7/2001 Kennedy
6,267,711 B1 7/2001 Hinds
6,319,179 B1 11/2001 Hinds
6,322,483 B1 11/2001 Rotella
6,348,026 B1 2/2002 Kuo
6,450,930 B1 9/2002 Kroke
6,500,102 B1 12/2002 Domenge
6,524,226 B2 2/2003 Kushner
6,726,601 B1 4/2004 Beutel
6,840,894 B2 * 1/2005 Lerner ..... 482/124
6,860,841 B1 3/2005 Mortorano
7,025,644 B2 * 4/2006 Geier et al. ..... 441/74
7,169,094 B2 1/2007 Ardito
2002/0187884 A1 12/2002 McGrath
2003/0096684 A1 5/2003 Combes et al.
2004/0152569 A1 * 8/2004 Lerner ..... 482/124
2006/0258519 A1 11/2006 Ardito
2007/0054789 A1 3/2007 Ardito
2007/0155600 A1 7/2007 Cunningham et al.

FOREIGN PATENT DOCUMENTS

WO WO 03-000348 1/2003
WO WO 2004-033051 4/2004

OTHER PUBLICATIONS

PowerVertex; "Kinetic Link Training"; website, http://www.powervertex.com/kttraining.htm_(2007).

* cited by examiner

RESISTANCE EXERCISE DEVICE

BACKGROUND AND SUMMARY

The present disclosure relates to a resistance exercise device.

Use of rubber resistance exercise tubes in connection with a wide variety of exercises is well known in the health and fitness industry. The rubber resistance exercise tubes are in the form of hollow tubes that provide resistance in response to stretching of the tubes. The amount of resistance typically depends upon the thickness of the tubes. Handles or other structure are secured to the resistance tube to provide exercise features and options.

The present disclosure relates to a resistance exercise device comprising at least one handle and a cord having a pair of ends and a length extending between the pair of ends. The handle is secured to one of the ends of the cord. The cord is stretchable from a relaxed state to extend the length. The cord comprises a plurality of tubes extending substantially the entire length of the cord. The tubes are conjoined together along substantially the entire length of the cord by means of braiding. The resistance exercise device may also comprise an other handle secured to the other end of the cord. Each of the tubes may be hollow along substantially its entire length.

The braiding may be snug along substantially the entire length of the cord, such that each of the tubes is in contact with at least one of the other tubes substantially along the entire length of the cord. The resistance exercise device may further comprise a plurality of plugs and a sleeve for securing the handle to the end of the cord.

Additional features of the present disclosure will become apparent to those skilled in the art upon consideration of the following detailed description of illustrative embodiments of the disclosure.

BRIEF DESCRIPTION OF THE DRAWINGS

The detailed description particularly refers to the accompanying figures in which.

DETAILED DESCRIPTION OF THE ILLUSTRATED EMBODIMENT

Figure 1:
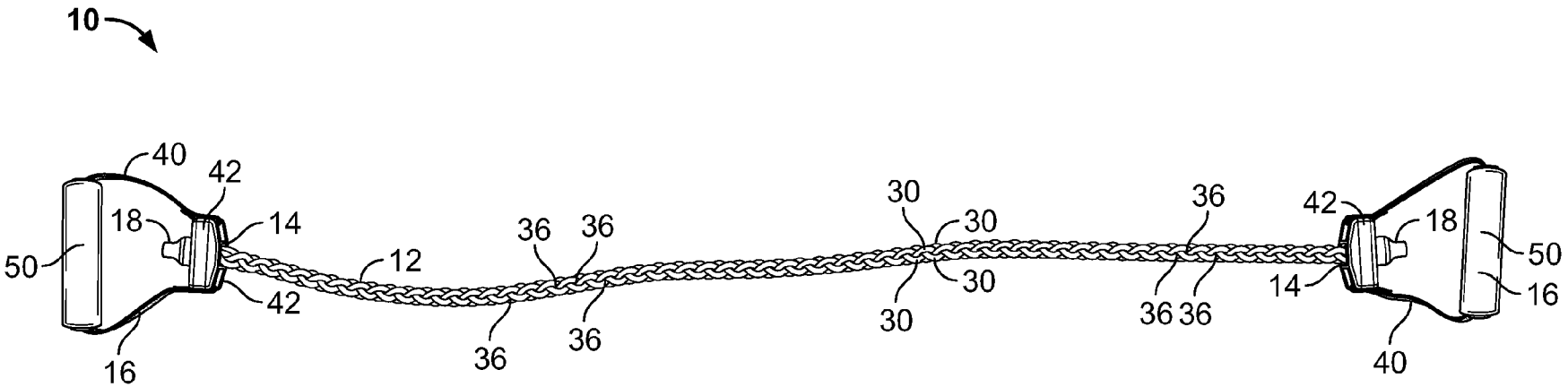
FIG. 1 is a perspective view of a resistance exercise device in accordance with an embodiment of the present disclosure, illustrating the cord of the resistance exercise device in a relaxed state.

While the present disclosure may be susceptible to embodiment in different forms, there is shown in the drawing, and herein will be described in detail, an embodiment with the understanding that the present description is to be considered an exemplification of the principles of the disclosure and is not intended to limit the disclosure to the details of construction and the arrangements of components set forth in the following description or illustrated in the drawing.

Figure 2:
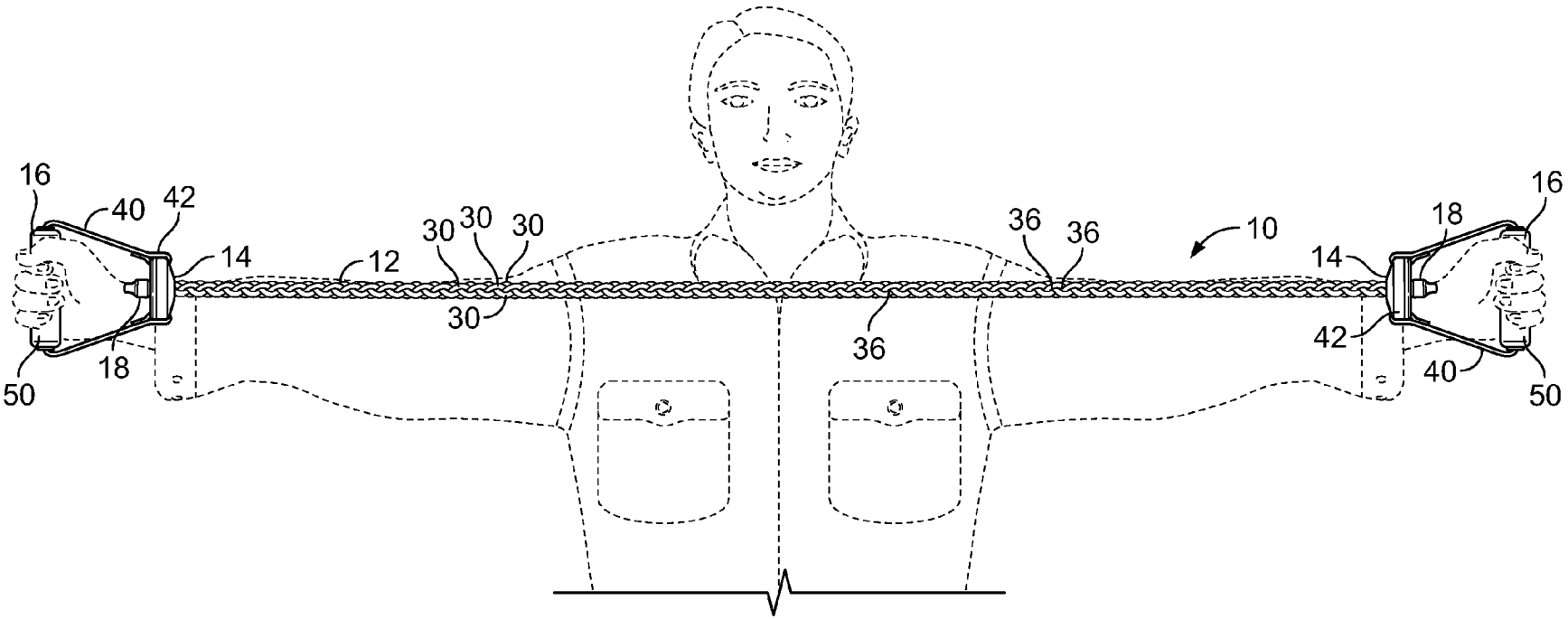
FIG. 2 is a perspective view of the resistance exercise device of FIG. 1 illustrating the cord pulled by a user to a stretched state.
Figure 3:
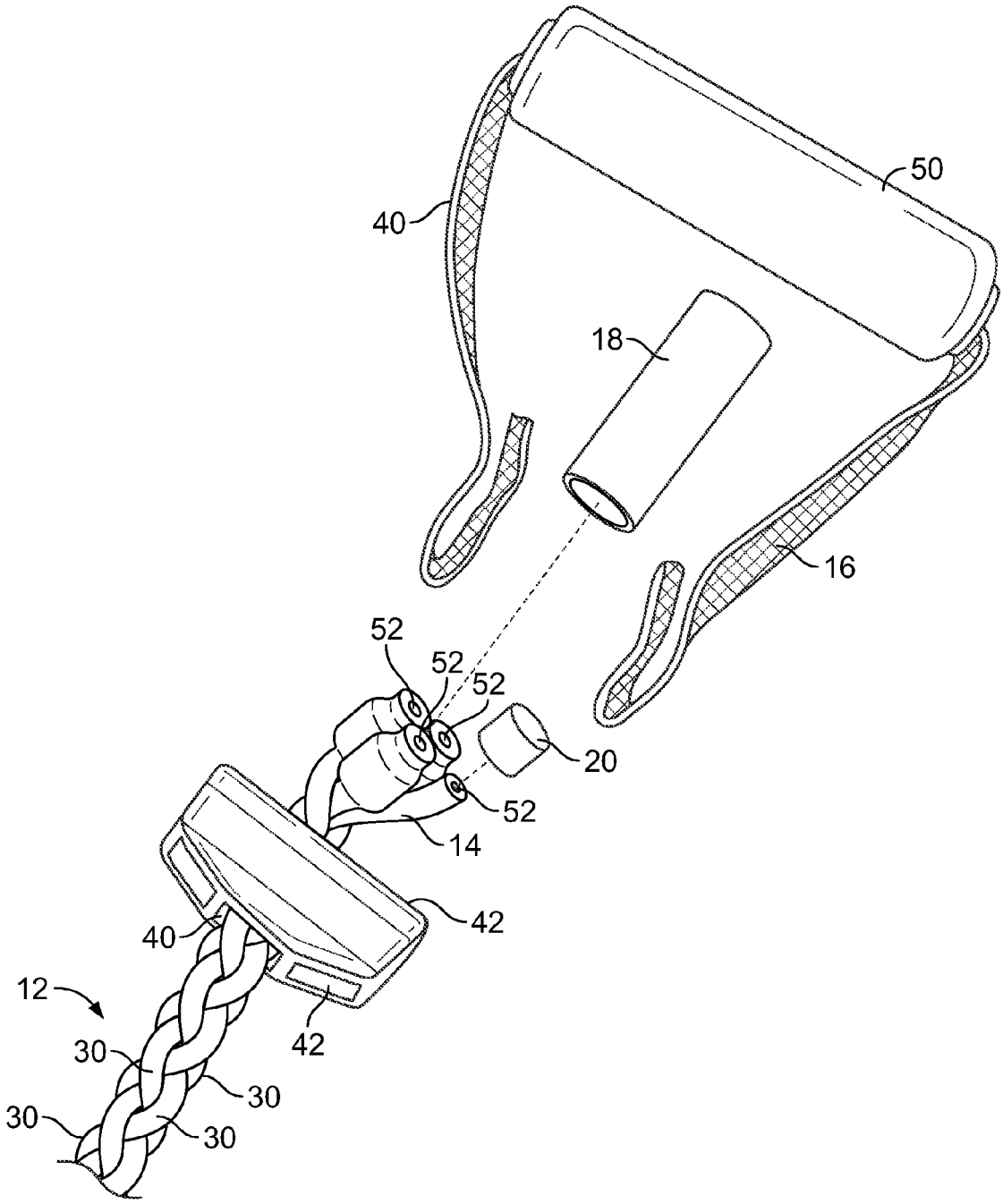
FIG. 3 is a partial exploded perspective view of one of the ends of the resistance exercise device of FIG. 1.

FIGS. 1-3 illustrate a resistance exercise device 10 in accordance with an embodiment of the present disclosure. The illustrated resistance exercise device 10 comprises generally a cord 12 having a pair of ends 14, a pair of handles 16, a pair of sleeves 18 and a plurality of plugs 20. Each of the handles 16 is secured to a respective one of the ends 14 of the cord 12 by a respective one of the sleeves 18 and a respective set of the plugs 20.

The cord 12 is shown in a relaxed state in FIG. 1, but can be stretched by application of any suitable pulling force during any type of exercise as shown, for example, in FIG. 2 to extend the length of the cord. The extent of stretching of the cord 12 depends upon the magnitude of the pulling force and the resistance of the cord 12.

The illustrated cord 12 comprises four hollow, elongated resistance tubes 30 conjoined together by means of braiding substantially the entire length of the cord. The braiding is snug such that when the cord is in either a relaxed state or stretched state each resistance tube 30 is in contact with one or more of the other resistance tubes 30 along substantially the entire length of the cord 12. With such construction, even when the cord is in a relaxed state, there are no openings along the length of the cord 12 except perhaps for small openings 36 defined adjacent the starting and ending points of contact between each pair of resistance tubes 30 which occur intermittently along the length of the cord. The cord 12 may be formed by more or less than four resistance tubes 30 in accordance with other embodiments of the present disclosure.

The illustrated resistance tubes 30 are constructed of rubber and may have any suitable dimensions. Each of the resistance tubes 30 may have any suitable construction, configuration and dimensions. The resistance tubes 30 may, for example, be any commercially available rubber resistance tube. The thickness of the tubes 30 affects the amount of resistance provided by the cord 12 during exercise.

The handles 16 may have any suitable construction, configuration and dimensions and may be secured to the ends of the cord 12 in any suitable manner. In the illustrated embodiment, for example, each handle 16 comprises a fabric strip 40 and an engaging member 42 defining a hole 44 receiving the cord 12 and a tubular hand grip 50 disposed about the fabric strip. The fabric strip 40 includes a pair of ends, with each end being secured to a respective side of the engaging member 42 by looping the end about a portion of the engaging member and stitching the end of the fabric strip or by any other suitable means such that the fabric strip and the engaging member 42 form a loop.

Each sleeve 18 may be disposed about the respective end 14 of the cord 12. Each plug 20 is received by a channel 52 defined along the length of a respective tube 30. Each plug 20 expands a portion of the respective tube 30. The plugs 20 at each end of the cord 12 thereby also expand a portion of the cord 12 and a portion of the respective sleeve 18 disposed about the plug. The hole 44 of the respective handle 16 is proximal of the plugs 20 at each end of the cord 12. As a result, the plugs 20 at each end prevent the respective handle 16 from disengaging from the cord 12 by preventing the respective engaging member 42 from moving distally of the plugs. The sleeve 18 protects the cord 12 from the wear and tear associated with the constant pulling of the handles 16. The plugs 20 and the sleeve 18 may be constructed of any suitable rubber or other material. For example, the plugs 20 may be constructed of a hard or compressed rubber or other rigid material and the sleeve may be constructed of any suitable rubber or other elastic material.

The handles 16 may have any other structure and may be secured to the cord 12 in any other suitable manner in accordance with other embodiments of the present disclosure. The handles 16, for example, may instead be in the form of the handles disclosed in U.S. Pat. No. 5,800,322 or may instead comprise any other type of strip 40 or any other type of structure. The strip 40 or other structure may be constructed of any suitable material and have any suitable configuration. Similarly, each of the engaging member 42, the hand grip 50, the sleeve 18, and the plugs 20 may have any other suitable construction or configuration or may be omitted in accordance with other embodiments. Further, any suitable other structure may be secured to the cord 12 or the handle 16 in accordance with other embodiments of the present disclosure.

The resistance exercise device 10 can be used in connection with a wide variety of exercises, including, for example, any type of exercise relating to strength training, core conditioning, stability and stretching. The resistance exercise device 10 can also be used in any suitable manner. Countless exercises can be performed with the resistance exercise device 10.

An advantage of the resistance exercise device 10 in accordance with the present disclosure is that it remains intact even if one of the resistance tubes 30 breaks. With the prior art resistance exercise devices, if the cord breaks, the resistance exercise device does not remain intact. With the resistance exercise device 10 in accordance with the present disclosure, however, if one of the resistance tubes 30 breaks during use, the resistance exercise device remains intact thus reducing if not eliminating any risk resulting from breakage of the cord.

While the concepts of the present disclosure have been illustrated and described in detail in the drawings and foregoing description, such an illustration and description is to be considered as exemplary and not restrictive in character, it being understood that only the illustrative embodiment has been shown and described and that all changes and modifications that come within the spirit of the disclosure are desired to be protected by the following claims:

The claimed invention is:

1. A resistance exercise device comprising at least one handle and a cord having a pair of ends and a length extending between the pair of ends, the handle being secured to one of the ends of the cord, the cord being stretchable from a relaxed state to extend the length of the cord, the cord comprising a plurality of tubes extending substantially the entire length of the cord, the tubes being conjoined together along substantially the entire length of the cord by means of braiding;

wherein each tube defines a channel at the one end of the cord;

the resistance exercise device further comprising a plurality of plugs for securing the handle to the one end of the cord, each plug received by the channel of a respective tube expanding a portion of the respective tube, and wherein the handle defines a hole receiving the cord proximal of the plugs.

2. The resistance exercise device of claim 1 further comprising an other handle secured to the other end of the cord.

3. The resistance exercise device of claim 1 wherein there are four of the tubes.

4. The resistance exercise device of claim 1 wherein the tubes arc conjoined together by said means of braiding such that the tubes are snug along substantially the entire length of the cord when the cord is in the relaxed state.

5. The resistance exercise device of claim 1 wherein the tubes are conjoined together by said means of braiding such that when the cord is in the relaxed state each of the tubes is in contact with at least one of the other tubes substantially along the entire length of the cord when the cord is in the relaxed state.

6. The resistance exercise device of claim 1 further comprising a sleeve disposed about the cord, the sleeve received by the hole, the plugs expanding a portion of the sleeve.

7. The resistance exercise device of claim 1 wherein each of the tubes is hollow along substantially its entire length.

8. A resistance exercise device comprising a pair of handles and a cord having a pair of ends and a length extending between the pair of ends, each handle being secured to a respective one of the ends, the cord being stretchable from a relaxed state to extend the length of the cord, the cord comprising a plurality of tubes extending substantially the entire length of the cord, the tubes being conjoined together snugly along substantially the entire length of the cord by means of braiding such that when the cord is in the relaxed state each of the tubes is in contact with at least one of the other tubes substantially along the entire length of the cord;

wherein there are four of the tubes;

wherein each of the tubes is hollow along substantially its entire length;

the resistance exercise device further comprising a plurality of plugs for securing the handles to the respective ends of the cord, each plug received by the channel of a respective tube at the end of the cord and expanding a portion of the respective tube, and wherein the handle defines a hole receiving the cord proximal of the plugs.

9. The resistance exercise device of claim 8 further comprising a pair of sleeves, each sleeve disposed about the respective end of the cord and received by the hole defined by a respective handle and being expanded by the plugs at the respective end of the cord.

* * * * *